US006131846A

United States Patent [19]

Muenster

[11] Patent Number: 6,131,846

[45] Date of Patent: Oct. 17, 2000

[54] DEVICE FOR HOLDING THE LEADING END OF THE WIRE ON A STAPLING WIRE SUPPLY REEL

[75] Inventor: Bruno Muenster, Bad Ditzenbach, Germany

[73] Assignee: Eastman Kodak Company, Rochester, N.Y.

[21] Appl. No.: 09/197,731

[22] Filed: Nov. 20, 1998

[30] Foreign Application Priority Data

Dec. 6, 1997 [DE] Germany ..... 197 54 205

[51] Int. Cl.[7] ..... B65H 19/29

[52] U.S. Cl. ..... 242/580

[58] Field of Search ..... 242/580, 125.2

[56] References Cited

U.S. PATENT DOCUMENTS

| | | | |
|---|---|---|---|
| 2,536,939 | 1/1951 | Johnson | 242/580 X |
| 3,333,783 | 8/1967 | Guernet | 242/580 X |
| 4,715,557 | 12/1987 | Rushing et al. | 242/580 X |
| 4,880,182 | 11/1989 | Gelfman | 242/580 X |
| 5,485,968 | 1/1996 | Fujioka | 242/125.2 |
| 5,549,257 | 8/1996 | Sanda et al. | 242/580 |
| 5,603,469 | 2/1997 | Stocchi | 242/580 |

FOREIGN PATENT DOCUMENTS

| | | |
|---|---|---|
| 169943 | 11/1904 | Germany . |
| 197 12 862 A1 | 3/1997 | Germany . |

*Primary Examiner*—Donald P. Walsh
*Assistant Examiner*—Emmanuel M. Marcelo
*Attorney, Agent, or Firm*—Lawrence P. Kessler

[57] ABSTRACT

A supply reel for staple wire is provided with a holder on which the leading end of the staple wire is held by clamping. The holder is held positively and/or non-positively on the reel flanges of the supply reel. The holder is configured to be removable from the supply reel and placeable on a finishing unit. Upon placement onto a finishing unit, clamping of the staple wire is abolished. Arranged on the holder are oil-impregnated felt pads between which the staple wire is guided. The holder is provided at both of its ends with flexible guide tubes which prevent bending of the leading end of the wire and protect the user from injury.

4 Claims, 5 Drawing Sheets

DEVICE FOR HOLDING THE LEADING END OF THE WIRE ON A STAPLING WIRE SUPPLY REEL

CROSS-REFERENCE TO RELATED APPLICATIONS

The invention claims priority of German Patent Application No. 19754205.0, filed Dec. 06, 1997, titled "Device For Holding The Leading End Of The Wire On A Stapling Wire Supply Reel," by Bruno Muenster.

FIELD OF THE INVENTION

The invention refers to a device for holding the outer leading end of a staple wire coiled on a supply reel, the supply reel having reel flanges and a reel core, and the reel core being provided with a bore for rotatable mounting of the supply reel on a spindle of the device.

BACKGROUND OF THE INVENTION

German Patent No. DE-PS 169 943 discloses a staple wire reel of the generic type in which a spring-loaded brake element, resting on the outer turn of wire, is provided. This brake element is attached to a protective cover which partially surrounds the staple wire reel when installed, and serves to brake the rotation of the reel and prevent uncontrolled detachment of the leading end of the wire. Outside the protective cover, however, the leading end of the wire on the staple wire reel is not secured against detachment, so that it can become bent, and there moreover exists a risk of injury from the protruding wire end.

SUMMARY OF THE INVENTION

The present invention is directed to overcoming one or more of the problems set forth above. Briefly summarized, according to one aspect of the present invention, a device for holding the outer leading end of a staple wire coiled on a supply reel, the supply reel having reel flanges and a reel core, and the reel core being provided with a bore for rotatably mounting the supply reel on a spindle of the device, characterized in that the outer leading end of the wire is attachable, in a manner secured against slipping out of place, to a removable holder which is continuously joined to the staple wire and can be joined positively and/or non-positively to the supply reel.

These and other aspects, objects, features, and advantages of the present invention will be more clearly understood and appreciated from a review of the following detailed description of the preferred embodiments and appended claims, and by reference to the accompanying drawings.

ADVANTAGEOUS EFFECT OF THE INVENTION

It is the object of the invention to hold the outer leading end of the wire on a staple wire reel such that it is held in a non-injurious fashion, secured against bending and unwinding, and in a manner suitable for simple threading-in. According to the invention, this object is attained in that the outer leading end of the wire is attachable, in a manner secured against slipping out of place, to a removable holder which is continuously joined to the staple wire and can be joined positively and/or non-positively to the supply reel.

Advantageously, the holder has an elastic clamping element which encloses a carrier on which are mounted oil-impregnated felt pads between which the staple wire is guided, and which is provided with claw-like clamping jaws for releasably clamping the leading end of the wire.

Advantageously, the elastic clamping element is attached to a U-shaped snap on bracket which overlaps the inside width of the reel flange and is attachable positively and/or non-positively to the outer flanks of the reel flange.

The holder comprises, moreover, at both of its ends elastic guide tubes which enclose the leading end of the staple wire to such an extent that it can be attached, protected against bending, both to the supply reel and to a wire guide of the device, e.g. a wire threading-in device. Advantageously, the holder also prevents unwinding of the staple wire. Because the leading end of the wire is arranged in protected fashion in a guide tube, there is also no risk of injury, so that the supply reel can be handled safely and easily. The holder also offers the advantage that a supply reel which has already been positioned, e.g. for service purposes, can be removed again even after the holder has been placed on the reel, the leading end of the wire being once again secured and protected in the same way.

BRIEF DESCRIPTION OF THE DRAWINGS

To facilitate understanding, identical reference numerals have been used, where possible, to designate identical elements that are common to the figures.

DETAILED DESCRIPTION OF THE INVENTION

Figure 1:
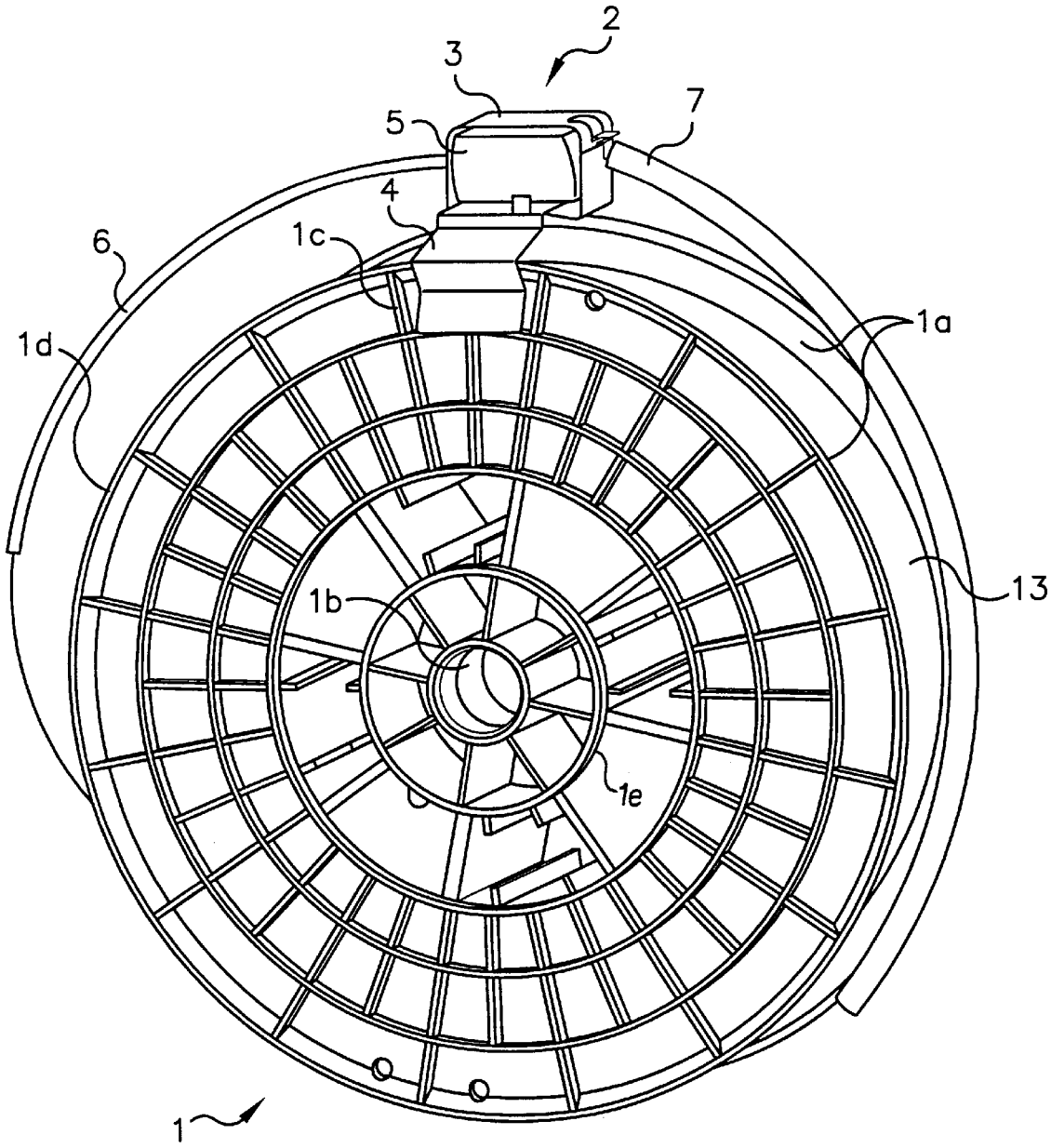
FIG. 1 is a supply reel with a holder in place.
Figure 5:
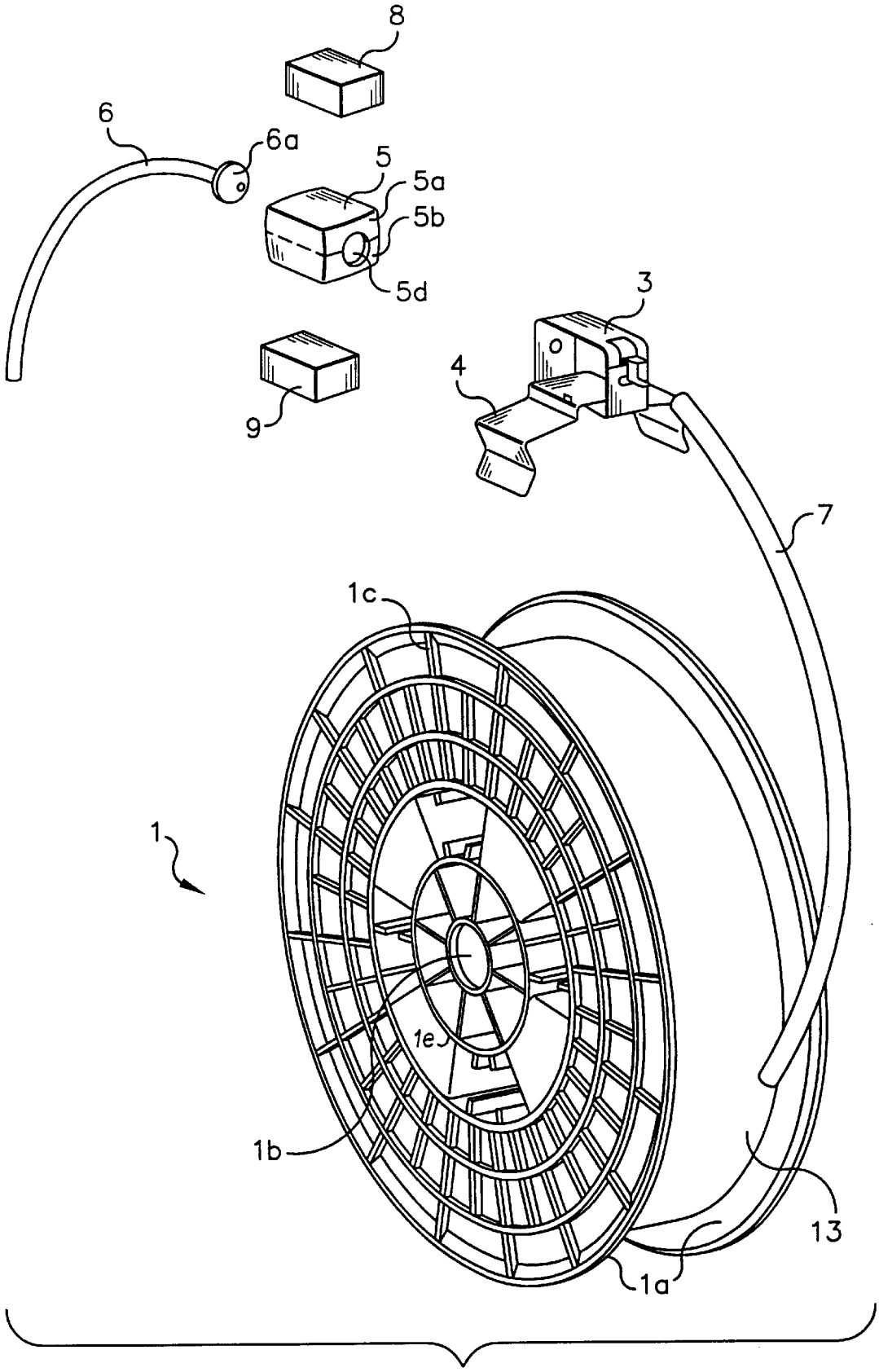
FIG. 5 is the supply reel with the holder according to FIG. 1, partially disassembled.
Figure 6:
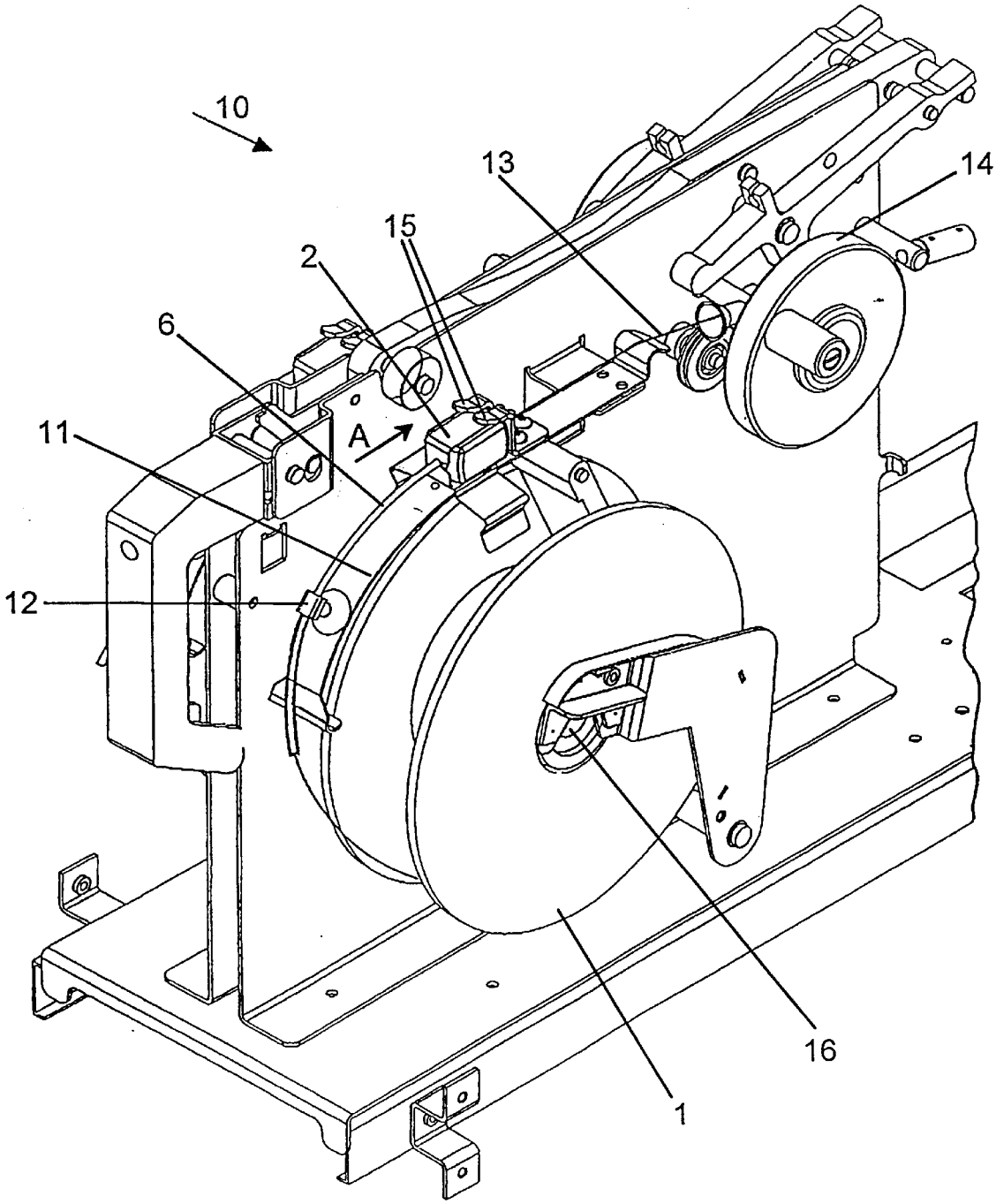
FIG. 6 is the supply reel with the holder according to FIG. 1, in an operative position.

A supply reel 1 of a commercially available type has, in known fashion and as shown in FIGS. 1 and 5, reel flanges 1*a* and a reel core 1*e* with a bore 1*b* for rotatable mounting on a spindle 16 (see FIG. 6). Wound onto supply reel 1 is staple wire 13, the inner end of which is attached in a known manner (not shown) to the reel core. The outer end of staple wire 13 is attached by clamping to a holder 2 evident from the Figures.

Figure 2:
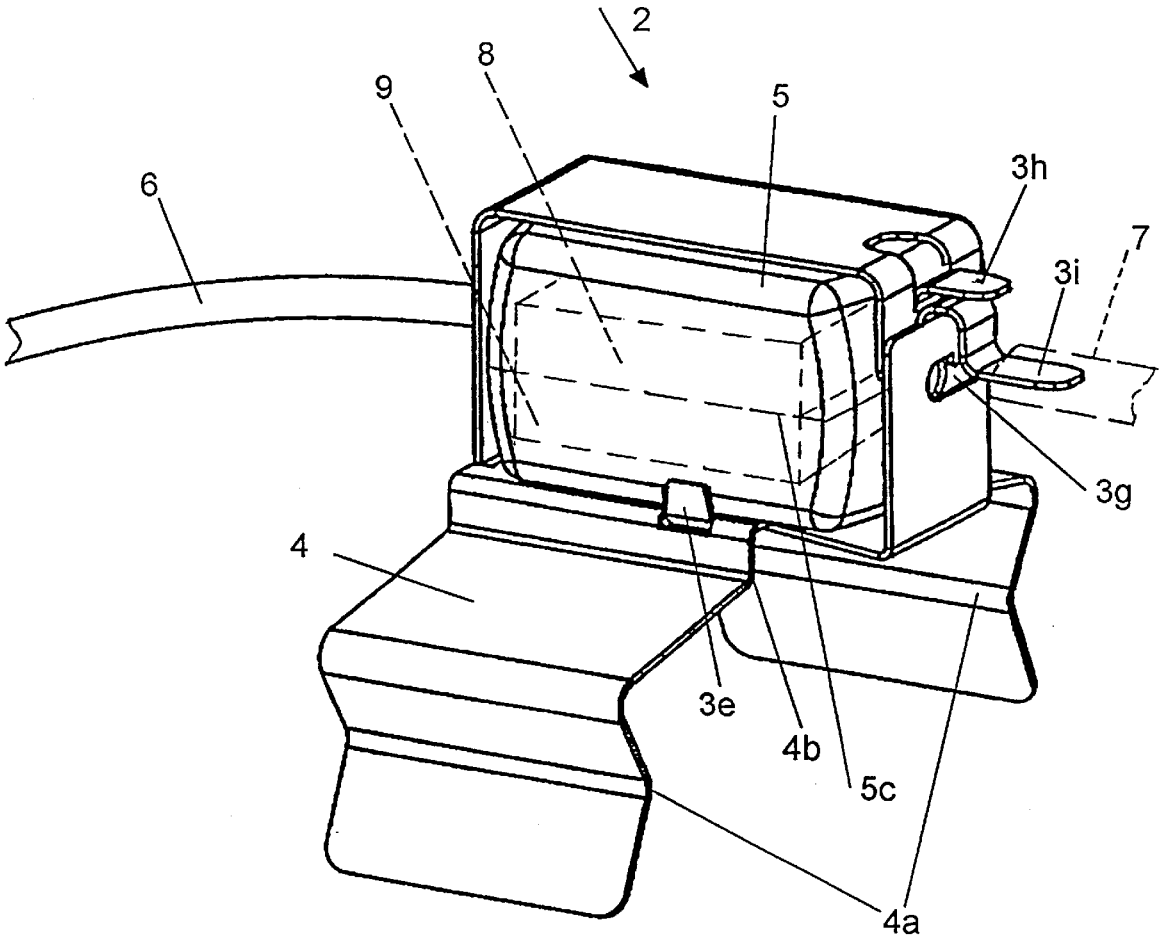
FIG. 2is an enlarged view of the holder according to FIG. 1.
Figure 3:
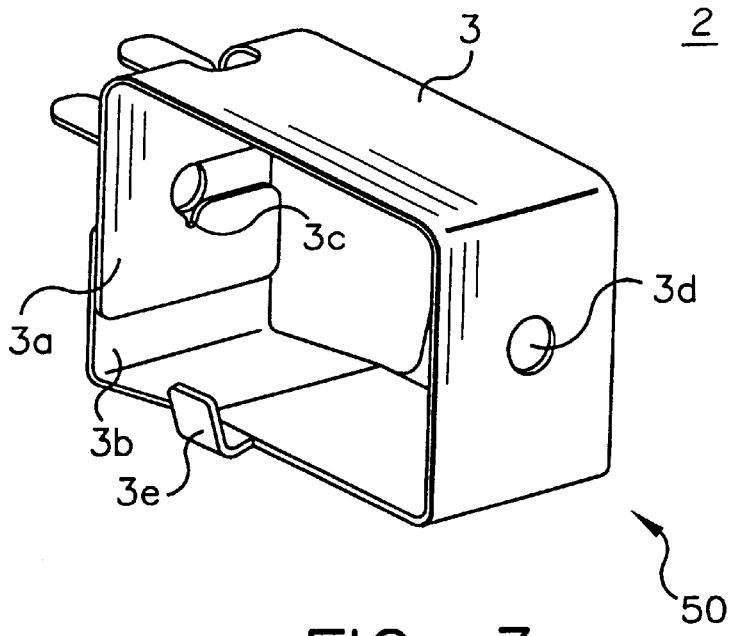
FIG. 3 is a partial view of the holder according to FIG. 2.
Figure 4:
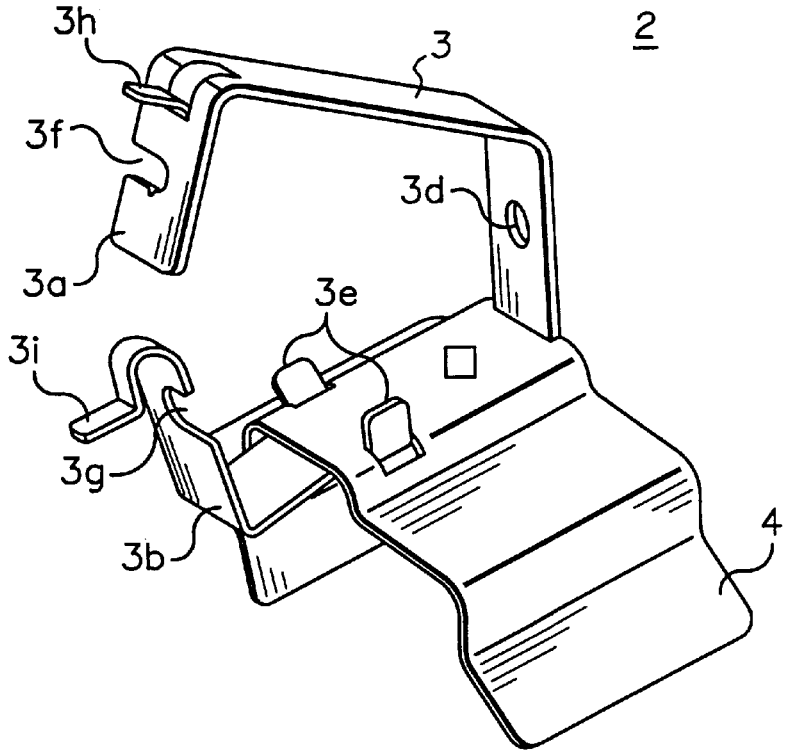
FIG. 4 is a partial view of the holder according to FIG. 2, in the open state.

Holder 2, which as shown in FIG. 1, is placed onto reel flange 1*a* of supply reel 1. Referring to FIGS. 3 and 4, holder 2 is provided with a clamping element 3 and a snap on bracket 4, which are made of sheet spring steel and are joined to one another by spot welding. Referring to FIG. 4, clamping element 3 has, in its relaxed position, with an upper clamping jaw 3*a* and a lower clamping jaw 3*b* which are joined to one another by a strip having an opening 3*d*. Upper clamping jaw 3*a* has an upper opening 3*f* with a notch 3*c* and is provided with a projection 3*h*. Lower clamping jaw 3*b* has a lower opening 3*g* and a projection 3*i*. Clamping element 3 is furthermore provided with two tabs 3*e* which pass through snap on bracket 4 and provide mutual immobilization and lateral retention of a carrier 5 as shown in FIG. 2. The upper and lower openings 3*f* and 3*g*, respectively, of clamping element 3 are open toward the side in opposite directions from one another, to allow the leading end of the wire to be threaded into holder 2.

As shown in particular by FIG. 2, snap on bracket 4 joined to clamping element 3 is provided with two V-shaped webs

4*a* which engage positively and non-positively beneath an outer annular bead id of reel flange 1*a* as shown in FIG. 1.

Referring to FIG. 5, arranged on holder 2 is carrier 5, which is made of plastic and has two shell-shaped halves 5*a* and 5*b*, not depicted in more detail, arranged opposite one another, said halves being joined to one another by a film hinge 5*c* (see FIG. 2) formed by a material constriction. Carrier 5 is provided at its end faces with openings 5*d* for staple wire 13. Arranged in the shell-shaped halves 5*a* and 5*b* are oil-impregnated felt pads 8 and 9 which serve to clean and lubricate staple wire 13.

Holder 2 is provided at each of its two ends with a flexible guide tube 6 and 7.

Referring to FIGS. 5, 3, and 4, holder 2 is assembled and handled as follows: Guide tube 6 is inserted, from the inside of clamping element 3, into hole 3*d* of clamping element 3 which is open as shown in FIG. 4, and held in position by a flange 6*a* located on the end. The leading end of the wire is then pushed into the flexible guide tube 6, and the open carrier 5, with felt pads 8, 9 in place, is closed over the leading end of the wire. The leading end protruding out of carrier 5 is then pivoted to the side into upper opening 3*f* until it is resting in notch 3*c* (FIGS. 3 and 4). Upper clamping jaw 3*a* is then pushed downward manually, thereby placing the carrier in positive alignment between clamping jaws 3*a*, 3*b*. The leading end of the wire can then be pivoted to the side into lower opening 3*g*, and upper clamping jaw 3*a* is then released. The spring preload which is thereby released clamps staple wire 13 against clamping jaws 3*a*, 3*b* so that it is immobilized and secured against slippage on holder 2. The flexible guide tube 7 is slid over the leading end of the wire which protrudes toward the front, and is secured non-positively on holder 2 by being slid onto projection 3i. Holder 2 is then placed onto reel flange 1*a*, where it is held positively and non-positively on its outer annular beads 1*d* (FIG. 1). The holder is also secured positively against lateral slippage between radial ribs 1*c* on the outer flanks of supply reel 1.

The leading end of the wire is thus immobilized on supply reel 1 in a manner secured against bending and unwinding, and is also arranged so as to prevent injury to the user. When supply reel 1 is to be brought into the operating position, it is placed on the stapling apparatus provided as a complete unit shown in FIG. 1.

To illustrate the advantageous handling of supply reel 1 with holder 2 in place, it will be described, for example, in conjunction with a threading-in device 10 for staple wire of a stapling device as defined in DE-PS 197 12 862.9. As depicted in FIG. 6, this threading-in device 10 has a spindle 16 on which supply reel 1 is rotatably mounted. Once supply reel 1 has been fixed in position, holder 2 is pulled off reel flanges 1*a*, and a flexible loop forming means 11, mounted on the device, is set in place, where it is aligned positively by means of a U-shaped guide 4*b* of snap on bracket 4 (see FIG. 2). By displacing holder 2 in the direction of the arrow "A" (see FIG. 6), the holder 2 arrives under two holddown elements 15, attached at a distance from one another on a flexible loop forming means 11, which push upper clamping jaw 3*a* downward so that the clamping of staple wire 13 by clamping jaws 3*a* and 3*b* is abolished. In the course of this displacement movement, projections 3*h* and 3*i* arrive between holddown elements 15, so that clamping element 3 and thus the entire holder 2 is fixed in position. Guide tube 6 is pushed into a clamping retainer 12 of flexible loop forming means 11, and the front guide tube 7 is pulled away from the leading end of the wire, which is now located in its threading-in position. Although clamping of the staple wire 13 has been released, it is held in non-positive engagement between felt pads 8 and 9 in such a way that it cannot shift during further handling. The leading end of the wire can now be introduced into a transport device 14 mounted on the device. The length of the exposed leading end of the wire is such that prior to transport device 14, it receives a slight curvature which preloads the leading end of the wire 13, resulting in easy infeed into transport device 14.

In a deviation from the embodiment depicted, holder 2 can also have a different configuration (not depicted) adapted to the particular conditions on the apparatus.

The invention has been described with reference to a preferred embodiment; however, it will be appreciated that variations and modifications can be effected by a person of ordinary skill in the art without departing from the scope of the invention.

PARTS LIST

1 supply reel
1*a* reel flange
1*b* bore
1*c* radial rib
1*d* annual bead of reel flange 1*a*
2 holder
3 clamping element
3*a* upper clamping jaw
3*b* lower clamping jaw
3*c* notch
3*d* opening
3*e* tab
3*f* upper opening
3*g* lower opening
3*h* projection
3*i* projection
4 snap on bracket
4*a* web
4*b* u-shaped guide
5 carrier
5*a* shell-shaped half
5*b* shell-shaped half
5*c* film hinge
5*d* opening
6 guide tube
6*a* flange
7 front guide tube
8 felt pad
9 felt pad
10 threading-in device
11 flexible loop forming means
12 clamping retainer
13 staple wire
14 transport device
15 holddown element
16 spindle

What is claimed is:

1. Device for holding the outer leading end of a staple wire coiled on a supply reel, the supply reel having reel flanges and a reel core, and the reel core being provided with a bore for rotatably mounting the supply reel on a spindle, characterized in that the outer leading end of the wire is attachable, in a manner secured against slipping out of place, to a removable holder, said removable holder being removably mounted to one of said reel flanges of said supply reel, and wherein the holder has an elastic clamping element which encloses an openable carrier on which are mounted oil-impregnated felt pads between which the staple wire is passed in its longitudinal direction; and that the clamping element is provided on an end arranged in the longitudinal direction of the staple wire with clamping jaws, movable in opposite directions, for releasably clamping the leading end of the wire.

2. Device as defined in claim 1, wherein the leading end of the wire is attachable to the holder by means of a releasable clamping element.

3. Device as defined in claim 1, wherein the elastic clamping element is attached to a U-shaped elastic snap on bracket which overlaps the inside width of the reel flange.

4. Device as defined in claim 1, wherein an elastic guide tube is attached at each of the two ends of the holder with respect to the longitudinal direction of the staple wire.

* * * * *